United States Patent [19]

Suzuki et al.

[11] Patent Number: 4,550,797

[45] Date of Patent: Nov. 5, 1985

[54] LOUDSPEAKER DIAPHRAGM MADE OF A MOLDED, SINTERED CERAMIC BODY

[75] Inventors: Kiyoaki Suzuki, Zama; Hidetsugu Suzuki, Sagamihara; Katsuhiro Onuki, Tokyo; Isami Nomoto, Yokohama; Yoshiaki Fukuda; Takeshi Sato, both of Yokoze, all of Japan

[73] Assignees: Victor Company of Japan, Yokohama; Mitsubishi Mining & Cement Co., Ltd., Tokyo, both of Japan

[21] Appl. No.: 571,652

[22] Filed: Jan. 17, 1984

[30] Foreign Application Priority Data

Jan. 17, 1983 [JP] Japan ..... 58-4143
Sep. 8, 1983 [JP] Japan ..... 58-164244

[51] Int. Cl.[4] ..... G10K 13/00; H04R 7/00

[52] U.S. Cl. ..... 181/167; 179/181 R; 501/119

[58] Field of Search ..... 181/168, 167; 428/64, 428/65, 312.6, 312.8; 179/115.5 R, 110 R, 110 A–110 F, 111 R, 181 R, 115.5 ES; 501/119, 118, 120; 264/86, 56, 175, 63

[56] References Cited

U.S. PATENT DOCUMENTS 4,221,773 9/1980 Tsukagoshi et al. ..... 181/167 X
4,401,911 8/1983 Ravinet et al. ..... 179/110 A X
4,494,032 1/1985 Martin ..... 179/110 A X

OTHER PUBLICATIONS

"Strength-Gain Size-Porosity Relations in Alumina", Journal of the American Ceramic Society, vol. 48, No. 1, Jan. 21, 1965, pp. 1–7, by E. M. Passmore, R. M. Spriggs, and T. Vasilos.

*Primary Examiner*—Russell E. Adams
*Assistant Examiner*—Brian W. Brown
*Attorney, Agent, or Firm*—Lowe, King, Price & Becker

[57] ABSTRACT

A loudspeaker diaphragm comprising a molded, sintered ceramic body is described. The body is made of ceramic crystalline particles whose maximum size is below 1/5 time a thickness of the body which is in the form of a dome or cone. The dome- or cone-shaped diaphragm may have a flange along an opening side thereof in order to prevent deformation as may occur during firing.

7 Claims, 3 Drawing Figures

LOUDSPEAKER DIAPHRAGM MADE OF A MOLDED, SINTERED CERAMIC BODY

BACKGROUND OF THE INVENTION

1. Field of the Invention

This invention relates to the sound reproduction and more particularly, to loudspeaker diaphragms of the type which are made of sintered ceramics.

2. Description of the Prior Art

As is well known in the art, dome-shaped loudspeakers usually comprise a diaphragm with an outer peripheral edge portion, a voice coil assembly adhered to the outer peripheral edge portion at an upper peripheral edge thereof, and an edge adhered also to the outer peripheral edge portion along the tip thereof, thereby permitting on-center mounting. This diaghragm system is set in a magnetic circuit made of a pole piece and a top plate.

With loudspeakers using a dome diaphragm of the justmentioned type, larger high resonance frequency, $f_H$, which initially produces a peak on an output sound pressurefrequency characteristic, results in a more extended upper frequency limit, permitting a wider usable range of frequency. It is generally accepted that if a thickness of the dome and a ratio of weights of the dome and a voice coil assembly are constant, the following empirical formula is established with respect to the high resonance frequency, $f_H$, $$f_H \alpha \frac{H}{D^2} \sqrt{\frac{E}{\rho}}$$

in which H is a height of the dome, D is a diameter of the dome, E is a Young's modulus of a dome material, $\rho$ is a density of the dome material, and $\sqrt{E/\rho}$ is a sound velocity of the dome material. The above formula demonstrates that a higher sound velocity of the dome material results in a higher $f_H$ value, with better results.

Known dome-shaped diaphragms are usually made of light metals such as aluminium, titanium and the like, resinimpregnated woven fabrics, and plastics such as polypropylene, polycarbonate and the like. The Young's moduli and sound velocities of these materials are very low as particularly indicated in Table 1 appearing hereinafter. Accordingly, high resonance frequencies cannot be expected using these materials, with a narrow usable range of frequency.

In contrast, aluminium oxide, which is typical of ceramic materials, has, for example, a Young's modulus about 8 times larger and a sound velocity about two times larger than those of metallic aluminium. The resonance frequency can be made higher by about two times as will be seen from Table 1. In other words, where a loudspeaker is constituted of a ceramic such as aluminium oxide, the upper frequency limit can be much more extended than will be expected from metallic aluminium or plastic materials.

TABLE 1

| Material | Young's Modulus $\times 10^{10}$ [Pa] | Index to Al | Density g/cm$^3$ | Index to Al | Sound Velocity Km/s | Index to Al | Rigidity Eh$^3$ | Index to Al |
|---|---|---|---|---|---|---|---|---|
| Aluminium | 7 | 1 | 2.7 | 1 | 5.1 | 1 | 3.6 | 1 |
| Titanium | 11 | 1.6 | 4.5 | 1.7 | 4.0 | 0.96 | 1.2 | 0.3 |
| Poly-propylene | 0.05 | | 0.9 | 0.3 | 0.75 | 0.15 | 0.7 | 0.2 |
| Paper | 0.05–0.3 | | 0.3–0.7 | | 1–2.3 | | 1.9–8.3 | |
| Single crystals of alumina | 52 | 7.9 | 3.95 | 1.5 | 11.4 | 2.2 | 8.4 | 2.3 |
| Poly-crystals of alumina | 38 | 5.3 | 3.9 | 1.4 | 9.9 | 1.9 | 6.4 | 1.8 |

Other factors which give great influence on acoustic characteristics of loudspeaker diaphragm include the weight of the diaphragm. The weight has a great relation to the efficiency of converting electrical signals into sound. Although diaphragms should be generally light in weight, a magnetic circuit of a specific type allows use of a diaphragm material which is about two times as heavy as aluminium with respect to density. However, higher densities bring about several disadvantages such as a lowering of sound pressure and a deterioration of frequency response of the diaphragm. Especially, in the case of super tweeter which is used in the highest frequency range, better acoustic characteristics are obtained when the sound velocity is higher, and the weights of the diaphragm and voice coil assembly are smaller.

Metallic aluminium dome-shaped diaphragms which are currently employed usually have a thickness of about 30 microns, whereas when aluminium oxide is used to make a dome-shaped diaphragm, its thickness inevitably exceeds about 100 microns and thus a diaphragm having a thickness of about 30 microns cannot be obtained. This leads to a weight of about 4 to 5 or more times greater than the weight of a metallic aluminium dome-shaped diaphragm, resulting in a lowering of sound pressure and a deterioration of frequency response of the diaphragm.

Moreover, fabrication of loudspeaker diaphragms using ceramic materials such as aluminium oxide essentially requires a firing process. This may cause deformation in the shape of the diaphragm during or after the firing which will not be experienced in the fabrication using metallic aluminium. Alternatively, the diaphragm may become irregular on the surfaces thereof after firing, resulting in breakage of the diaphragm at the time of assembling of a loudspeaker.

SUMMARY OF THE INVENTION

It is an object of the present invention to provide loudspeaker diaphragms, in either dome or cone form, which are made of molded, sintered ceramics whereby acoustic characteristics of the diaphragm are substantially improved over those of known metallic diaphragms.

It is another object of the invention to provide loudspeaker diaphragms which are high in rigidity and can provide a reduced degree of nonlinear distortion, thus being high in electroacoustic conversion efficiency.

It is a further object of the invention to provide loudspeaker diaphragms which have an extended upper frequency limit over known metallic diaphragms.

It is a still further object of the invention to provide loudspeaker diaphragms made of molded, sintered ceramics which suffer little or no deformation in shape during firing and which can be fabricated in high yield in a desired form.

The above objects can be achieved, according to the invention, by a loudspeaker diaphragm which essentially consists of a molded, sintered body, in either dome or cone form, of ceramic grains whose maximum size is below 1/5 time a thickness of the body.

DETAILED DESCRIPTION AND PREFERRED EMBODIMENTS OF THE INVENTION

Figure 1:
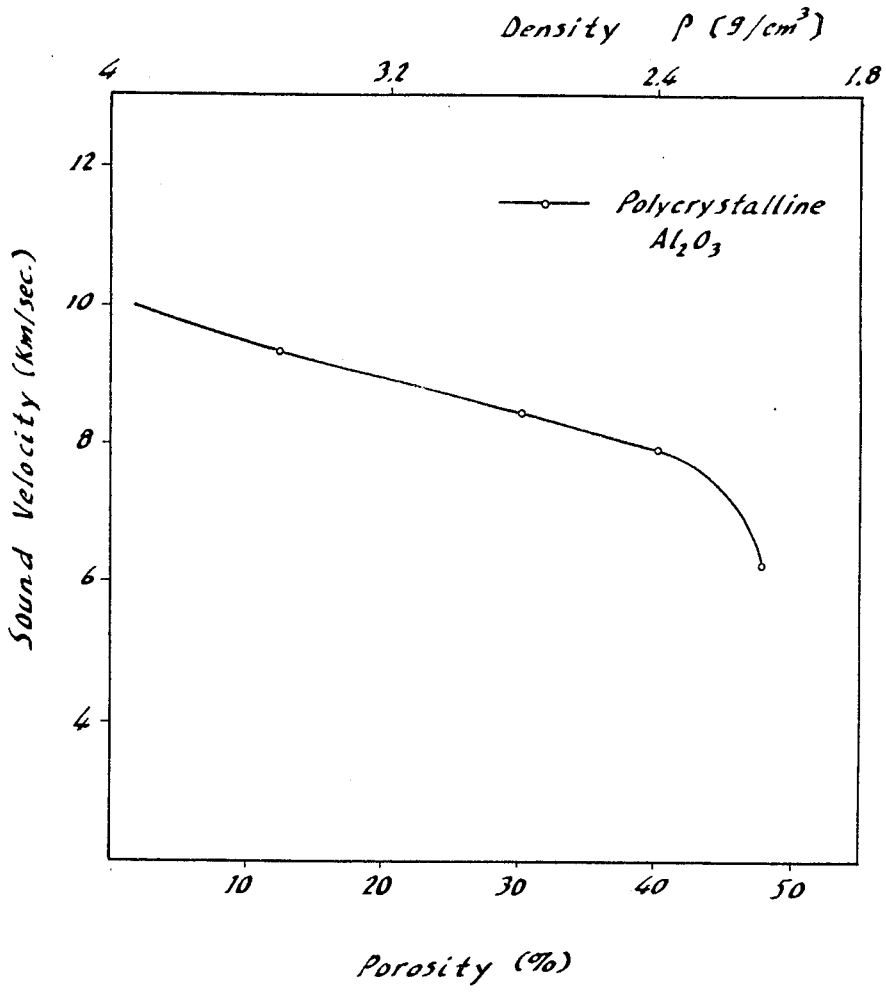
FIG. 1 is a graph showing relations among porosity, density and sound velocity of an alumina diaphragm.

As defined before, the loudspeaker diaphragm of the present invention substantially consists of a sintered body molded in desired shape made of ceramic grains whose maximum size should be as small as below 1/5 time a thickness of the body. In general, the thickness of the body for this purpose is in the range of 30 to 100 microns.

As is well known in the art, acoustic characteristics of a loudspeaker diaphragm decrease with an increase of the thickness and particularly the weight of the diaphragm. On the contrary, when the diaphragm is small in thickness, there arise problems in that the diaphragm lower in strength, so that it could not withstand high power conditions.

In order to ensure sufficient strength while causing the diaphragm to be smaller in thickness than in ordinary cases using ceramics, the use of ceramics having a smaller grain size is used in view of the fact that the relation between strength, S, and grain size, G, can be expressed as $S=AG^{-a}$ in which A and a are constants relating to porosity (see Journal of The American Ceramic Society, Vol. 48, Jan. 21, 1965). In other words, high strength is ensured when the grain size of ceramics is small, leading to fabrication of a thin loudspeaker diaphragm of good performance.

However, if ceramics of a small grain size are used to obtain a thin diaphragm, there frequently occurs a phenomenon upon firing where a molded diaphragm becomes irregular on the surfaces thereof. Accordingly, a loudspeaker diaphragm of a desired shape cannot be obtained. For instance, with a loudspeaker diaphragm having a thickness of about 30 microns, ceramic grains having a maximum size over about 6 microns are not suitable because they deform to a great extent upon firing. The resulting diaphragm becomes irregular. If the maximum grain size is below 6 microns, deformation upon firing is minimized for a 30 micron thick diaphragm. It should be noted that deformation in shape caused upon firing becomes marked especially when the diaphragm thickness is as small as below 100 microns.

In order to effectively minimize deformation in shape at the time of firing, it is sufficient that a diaphragm of, for example, a dome or cone shape be provided with a flange along the periphery thereof at the opening end thereof. The flange formed at the opening end of the diaphragm is effective in preventing the deformation in shape as would occur upon firing. This is completely different from prior art cases using metals as a dome or cone in which when a flange is provided, which has the effect of of increasing the resonance frequency of the diaphragm. This is because if a flange is formed along the peripheral end of a dome- or cone-shaped diaphragm, the stress caused by release of the internal strain involved at the time of firing is considered to be exerted on, for example, the dome and the flange so that deformation of the shaped is prevented.

As a result, the loudspeaker diaphragm is not as deformed as in the form of so-called Napoleon's hat so that the inflection point in shape of the diaphragm ranging from its outer to inner circumference does not become inner with respect to an adhesion portion between the diaphragm and a voice coil. Thus, the resonance frequency of the diaphragm does not lower. When a flange is provided, it is important to determine an optimum length or width of the flange. The flange serves not only to prevent shape deformation at the time of firing, but also to raise the resonance frequency of the diaphragm and improve the power handling capacity due to an increase in rigidity of the diaphragm as a whole. For instance, according to calculations by the finite element method, the resonance frequency increases with a length of flange as particularly indicated in Table 2 below. The resonance frequency becomes 1.27 times as high as that of a case using no flange when a flange ratio (i.e. a ratio of a length or width of the flange to an aperture of the dome- or cone-shaped diaphragm) is 0.02, 1.48 times higher when the flange ratio is 0.04, and 1.7 times higher when the flange ratio is 0.08. However, if the flange is too long, the resonance frequency of the flange becomes lower than a resonance frequency of the diaphragm, causing peaks or dips to appear on sound pressure-frequency characteristics. In this connection, when, for example, the flange ratio is 0.08, the resonance frequency of the flange is 0.32 times as low as the resonance frequency of a dome-shaped diaphragm having no flange. Accordingly, if a flange is provided, the flange ratio should preferably be below 0.03, inclusive.

TABLE 2

| Flange ratio | 0 | 0.01 | 0.02 | 0.04 | 0.08 |
|---|---|---|---|---|---|
| Resonance frequency of a flanged dome/resonance frequency of flange-free dome | 1 | 1.13 | 1.27 | 1.48 | 1.7 |
| Resonance frequency of flange/resonance frequency of flange-free dome | | large | large | 1 | 0.32 |

In a preferred aspect, the maximum grain size should be below 2 microns with an average size being below 1 micron. Moreover, in order to increase mechanical strength of ceramic diaphragms, it is convenient to increase the thickness of the diaphragm. The increase of the thickness undesirably results in an increase in weight of the diaphragm To avoid this, a porosity of the ceramic diaphragm has to be increased. In FIG. 1, there are shown the relationships among the density, porosity and sound velocity. From the figure, it will become apparent that when the porosity exceeds 40%, the sound velocity abruptly lowers, leading to an unfavorable lowering of high resonance frequency. Accordingly, the porosity should be in the range below 40%. By this arrangement, the high resonance frequency of the ceramic diaphragm can be increased to about two times as high as that of an aluminium diaphragm. In addition, the weight of the ceramic diaphragm itself does not increase as much, so that a good electroacoustic conversion efficiency can be attained.

For the manufacture of ceramic diaphragms for loudspeakers according to the invention, a colloidal system comprising one or more inorganic materials as a dispersion phase is used as a starting ceramic material and is admixed with a hydrophilic organic polymer. The system is concentrated to a predetermined concentration and cast on a glass or similar plate, followed by drying to obtain a green ceramic sheet. The green sheet is press molded in the desired form of loudspeaker diaphragm. The molding is fired conventionally, for example, at a temperature of from 800° to 1700° C. thereby obtaining a loudspeaker diaphragm having a thickness of about from 30 to 100 microns and a density of 2.7 to 4.0 g/cm$^3$.

In the above manufacturing process, colloidal particles which are uniform in size and quality are used, so that the resulting loudspeaker diaphragm is made of a ceramic or ceramics with a uniform grain size with its acoustic characteristics being good. By suitably controlling the type and amount of hydrophilic organic polymer, and the firing temperature, the grain size can be readily, properly controlled. Thus, a loudspeaker diaphragm having desired acoustic characteristics can be readily fabricated.

Inorganic materials used as a dispersion phase of the colloidal system are not restrictive and include, for example, oxides, hydroxides and their hydrous compounds of metals or non-metals such as Al, Mg, Si, Ti, Ba, B, Pb, Zn, Zr, Be and the like. Needless to say, these materials or compounds may be used singly or in combination. Preferably, there are used ceramic materials which are obtained by hydrolyzing one or more alkoxides of these metals or nonmetals. For instance, 1 mole of aluminium isopropoxide, [$Al(C_3H_7O)_3$], is added to 100 mole of water and hydrolyzed at about 80° C. for 30 minutes, thereby obtaining boehmite, [AlO(OH)]. To the boehmite is added a small amount of hydrochloric acid for peptization to obtain a stable pseudoboehmite sol. This sol is a kind of colloid having a uniform particle size. By this method, a starting colloid of high purity can be readily obtained.

Typical of the hydrophilic organic polymer is polyvinyl alcohol. The amount of the polymer depends on the porosity of a final ceramic diaphragm and preferably ranges from 30 to 40 wt% of the total solids. Aside from the polymers, a plasticizer or other additives may be added to the colloidal system.

The present invention is particularly described by way of example.

EXAMPLE 1

A colloidal solution obtained by hydrolyzing aluminium isopropoxide and magnesium methoxide and having a molar ratio of $Al_2O_3$ and MgO of 97:3 was admixed with a polyvinyl alcohol binder and a glycol plasticizer. The resulting mixture was applied onto a glass plate by a doctor blade technique and dried to obtain a 100 micron thick ceramic green sheet having a binder content of 30 wt%.

Figure 2:
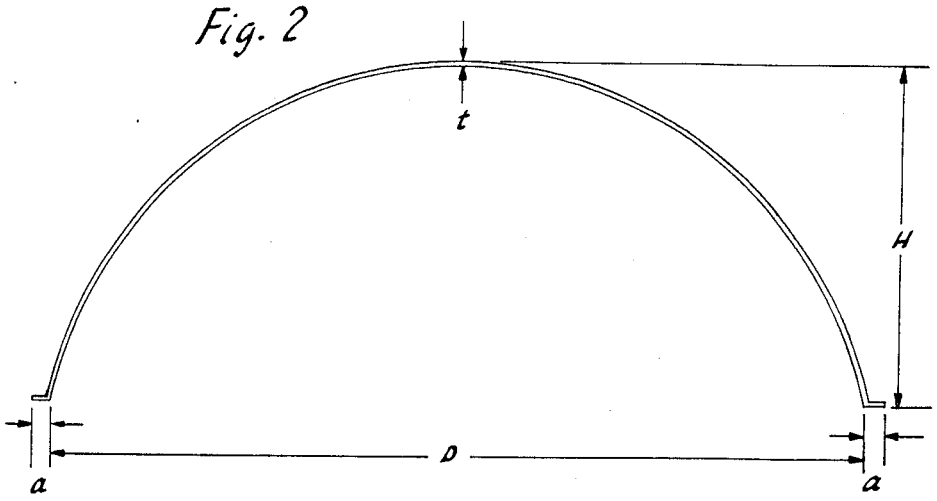
FIG. 2 is a schematic view showing a loudspeaker diaphragm according to one embodiment of the present invention.

The green sheet was press molded in a diaphragm mold under heating conditions, after which it was fired in air at 1400° C. for 3 hours to obtain a loudspeaker diaphragm of a dome shape as shown in FIG. 2 but no flange was provided. The diaphragm had a thickness, t, of 47 microns, a height, H, of 5.0 mm, and a diameter, D, of 34 mm.

The diaphragm material mainly composed of alumina was used to determine its porosity by a mercury porosimeter, with the result that the porosity was 13%. The fine structure of the diaphragm material was observed through a scanning-type electron microscope, revealing that pores were uniformly distributed throughout the material and that most grains had a size below 1 microns with a part thereof having a size about 1.4 microns. An average grain size determined according to the Fullman method was 0.8 micron.

EXAMPLE 2

A colloidal solution obtained by hydrolyzing aluminium isopropoxide and adding a small amount of mineral acid to the hydrolyzate for peptization was admixed with a polyvinyl binder and ethylene glycol and kneaded. The mixture was cast on a glass plate and dried to obtain a 100 microns thick ceramic green sheet containing 40 wt% of the binder.

The green sheet was thermally press molded in a mold for diaphragm and fired in air at 1100° C. for 2 hours, thereby obtaining a dome-shaped diaphragm, as shown in FIG. 2 except that no flange was provided, having a thickness of 57 microns, a height of 5.0 mm and a diameter of 34 mm.

The diaphragm material was tested in the same manner as in Example 1, with the result that the porosity was 33% and the grain size was below 0.2 micron with pores being uniformly distributed throughout the material. An average grain size determined by the Fullman method was 0.07 micron.

The ceramic loudspeaker diaphragms obtained in Examples 1 and 2 had the following physical properties.

TABLE 3

| | Young's Modulus | | Density | | Sound Velocity | | Rigidity | |
|---|---|---|---|---|---|---|---|---|
| | $\times 10^{10}$ [Pa] | Index to Al | g/cm$^3$ | Index to Al | Km/s | Index to Al | Eh$^3$ | Index to Al |
| Example 1 | 31 | 4.4 | 3.5 | 1.3 | 9.2 | 1.8 | 7 | 1.9 |
| Example 2 | 20 | 2.9 | 2.7 | 1 | 8.5 | 1.7 | 9 | 2.5 |

As will be seen from the above results, the ceramic diaphragms of the invention are larger in sound velocity by 1.7 to 1.8 times than an aluminium diaphragm. The rigidity of the ceramic diaphragms is higher by 1.9 to 2.5 times than that of an aluminium diaphragm. Because the density is higher only by 1 to 1.3 times than that of an aluminium diaphragm, an upper frequency limit can be extended to 1.7 to 1.8 times. In addition, the ceramic diaphragms vibrate at the same phase because of the high rigidity, with a reduced degree of non-linear distortion and a high electroacoustic conversion efficiency.

EXAMPLE 3

A colloidal solution obtained by hydrolyzing aluminium isopropoxide and magnesium methoxide to have a molar ratio of $Al_2O_3$ and MgO of 97:3 was admixed with a polyvinyl alcohol binder and a glycol plasticizer in suitable amounts and kneaded. The mixture was applied by a doctor blade technique and dried to obtain an about 60 microns thick ceramic green sheet having the binder content of 30 wt%.

The green sheet was thermally press molded in a mold for diaphragm and fired in air at about 1600° C. for about 3 hours, thereby obtaining a dome-shaped loudspeaker diaphragm with a flange mainly composed of alumina. This type of diaphragm is just as shown in FIG. 2. The diaphragm had a height, H, of 5 mm, a thickness, t, of about 30 microns, a length of the flange, a, of about 0.5 mm, and a diameter of the dome, D, of 24.6 mm. The ceramic material had a maximum grain size of about 5 microns and a density of about 3.9 $g/cm^3$ which was approximately the same as the density of single crystals.

The loudspeaker diaphragm obtained in the above example involved little deformation in shape during the firing process. Thus, diaphragms of a desired shape could be fabricated accurately and in high yield. It was found that the difference in amplitude level between the flange portion and the dome portion was very small over a wide frequency range, ensuring an ideal piston motion of the diaphragm.

Figure 3:
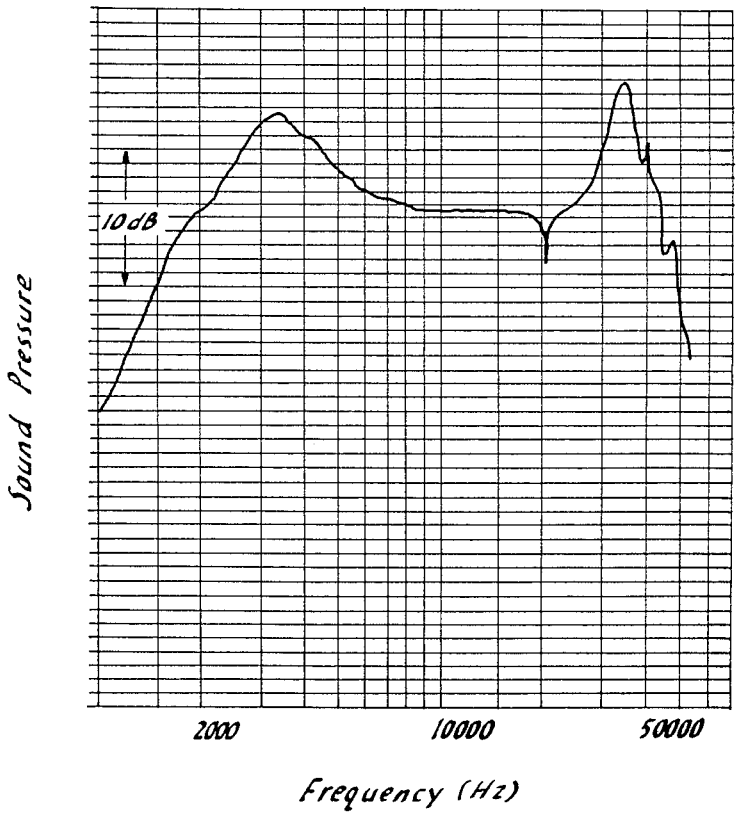
FIG. 3 is a graph showing a sound pressure-frequency characteristic of a dome-shaped diaphragm according to the invention.

The sound pressure-frequency characteristic of a loudspeaker using the diaphragm of this example was determined with the results shown in FIG. 3. This figure reveals that the resonance frequency of the flange portion exceeds a resonance frequency of the diaphragm itself. That is, no dip caused by the resonance of the flange portion appears except a dip caused by the edge resonance frequency at about 20 KHz, thus showing good results.

The peak of the high resonance appears at about 35 KHz and thus the ceramic diaphragm loudspeaker is much improved in high resonance frequency over an aluminium loudspeaker of the same shape, with reduced degrees of secondary and tertiary harmonic distortions.

The loudspeaker diaphragm obtained in this example had a sound velocity two times as high as an aluminium diaphragm with its rigidity being about 5 times higher. Additionally, the density of the ceramic diaphragm was only about 1.4 times the aluminium diaphragm, so that the upper frequency limit could be extended to about 1.5 times that of an aluminum diaphragm. Because of high rigidity, the ceramic diaphragm could vibrate at the same phase with a reduced degree of nonlinear distortion and a high electroacoustic conversion efficiency.

What is claimed is:

1. A ceramic loudspeaker diaphragm in cone or domed form and having an opening at one end thereof, said diaphragm comprising crystal grains of a ceramic, said crystal grains having a maximum size of below 1/5 times a thickness of said diaphragm, the thickness of said diaphragm ranging from 30 to 100 microns.

2. A loudspeaker diaphragm according to claim 1, wherein the maximum grain size is below 2 microns and an average size of said crystal grains is below about 1 micron.

3. A loudspeaker diaphragm according to claim 1, wherein said ceramic is a member selected from the group consisting of oxides, hydroxides, hydrous compounds and mixtures thereof of Al, Mg, Si, Ti, Ba, B, Pb, Zn and Be.

4. A loudspeaker diaphragm according to claim 3, wherein said ceramic is alumina.

5. A loudspeaker diaphragm according to claim 3, wherein said ceramic is a mixture of alumina and magnesia.

6. A loudspeaker diaphragm according to claim 1, wherein said diaphragm has a flange along the peripheral end thereof.

7. A loudspeaker diaphragm according to claim 1, wherein said diaphragm has a porosity below 40%.

* * * * *